US007361073B2

(12) United States Patent
Martin et al.

(10) Patent No.: US 7,361,073 B2
(45) Date of Patent: Apr. 22, 2008

(54) MOTION RESPONSIVE TOY

(75) Inventors: Raymond J. Martin, Sherman Oaks, CA (US); Darin Barri, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/198,170

(22) Filed: Aug. 4, 2005

(65) Prior Publication Data

US 2006/0046606 A1 Mar. 2, 2006

Related U.S. Application Data

(60) Provisional application No. 60/600,636, filed on Aug. 10, 2004.

(51) Int. Cl.
*A63H 33/26* (2006.01)

(52) U.S. Cl. ..... 446/129; 446/175

(58) Field of Classification Search ..... 446/129–130, 446/242

See application file for complete search history.

(56) References Cited

U.S. PATENT DOCUMENTS

| | | | | |
|---|---|---|---|---|
| 3,223,412 | A | 12/1965 | Freeman et al. | |
| 3,798,833 | A | 3/1974 | Campbell | |
| 3,965,613 | A | 6/1976 | Saunders | |
| 4,114,305 | A | 9/1978 | Wohlert et al. | |
| 4,248,422 | A | 2/1981 | Messina | |
| 4,333,258 | A | 6/1982 | McCaslin | |
| 4,601,668 | A | 7/1986 | Sirota | |
| 5,007,877 | A | 4/1991 | Watson | |
| 5,791,648 | A | 8/1998 | Hohl | |
| 5,811,896 | A | 9/1998 | Grad | |
| 6,325,690 | B1 * | 12/2001 | Nelson | 446/25 |
| 6,431,937 | B1 * | 8/2002 | Lau et al. | 446/175 |
| 2001/0050461 | A1 | 12/2001 | Tarbell | |

FOREIGN PATENT DOCUMENTS

| | | |
|---|---|---|
| FR | 2751886 | 2/1998 |
| WO | 2004/087271 A1 | 10/2004 |

OTHER PUBLICATIONS

Abstract (in English) of French Parent No. FR2751886.

* cited by examiner

*Primary Examiner*—Robert E Pezzuto
*Assistant Examiner*—Alex F. P. Rada, II
(74) *Attorney, Agent, or Firm*—Edell Shapiro & Finnan LLC

(57) ABSTRACT

A toy may include a housing, an electromagnetic-field sensor, an output, a controller, and/or a source of an electromagnetic field. The housing may be adapted to be supported on a support surface. In some examples, the housing may support the field sensor in a fixed orientation or position relative to the support surface. In some examples, the field sensor may be adapted to produce a signal having a magnitude representative of a change in a field passing through the sensor. In some examples the output may have a changeable sensible output. The controller may be adapted to operate the output to have different outputs for different magnitudes of the signal. The source of the field may be moveable by a user relative to the sensor to expose the sensor to a field that changes according to the movements of the source by the user.

11 Claims, 4 Drawing Sheets

MOTION RESPONSIVE TOY

CROSS REFERENCE TO RELATED APPLICATIONS

The present application claims priority from U.S. Provisional Patent Application Ser. No. 60/600,636 filed Aug. 10, 2004, incorporated herein by reference in its entirety for all purposes.

BACKGROUND

The present disclosure is directed to children's motion-responsive toys, and more specifically to children's toys including a user-movable portion containing a magnetic-field source and a base unit responsive to movement of the magnetic-field source. Disclosures of games or toys that incorporate a magnet or a magnetic field are found in U.S. Pat. Nos. 3,223,412, 3,798,833, 3,965,613, 4,248,422, 4,333,258, 4,601,668, 5,007,877, 5,811,896 and 6,325,690, U.S. Patent Application Publication No. 2001/0050461, and French Patent No. 2,751,886. The disclosures of each of these references are incorporated herein by reference.

SUMMARY OF THE DISCLOSURE

A toy may include a housing, an electromagnetic-field sensor, an output, a controller, and/or a source of an electromagnetic field. The housing may be adapted to be supported on a support surface. In some examples, the housing may support the field sensor in a fixed orientation or position relative to the support surface. In some examples, the field sensor may be adapted to produce a signal having a magnitude representative of a change in a field passing through the sensor. In some examples the output may have a changeable sensible output. The controller may be adapted to operate the output to have different outputs for different magnitudes of the signal. The source of the field may be moveable by a user relative to the sensor to expose the sensor to a field that changes according to the movements of the source by the user.

DETAILED DESCRIPTION

Fantasy and magic serve as common themes upon which children's play settings and situations are based, and children enjoy playing with toys that further such themes. Such thematic toys may include items such as magic wands and other user-movable pieces, for example, to allow a child to simulate casting a magical spell or magically producing a sensed action.

A toy may include a housing, an electromagnetic-field sensor, an output, a controller, and/or a source of an electromagnetic field. In some examples, the electromagnetic-field sensor may be supported in the housing, and adapted to produce a signal having a magnitude representative of a change in a electromagnetic field passing through the sensor. The output may be changeable. The controller may be adapted to change the output for different magnitudes of the signal. Further, the source of an electromagnetic field may be moveable by a user relative to the sensor to expose the sensor to an electromagnetic field that changes according to movement of the source relative to the sensor by the user.

A method of operating a field-responsive toy may include moving the field source relative to the sensor, detecting a change in the field in the sensor, producing a signal having a magnitude representative of the detected change in the field, and in response to the produced signal, producing a sensible output representative of the detected change in the field. In some examples, the method may include detecting a different change in the field in the sensor, producing a signal having a magnitude representative of the detected different change in the field, and producing a different sensible output representative of the detected different change in the field.

Figure 1:
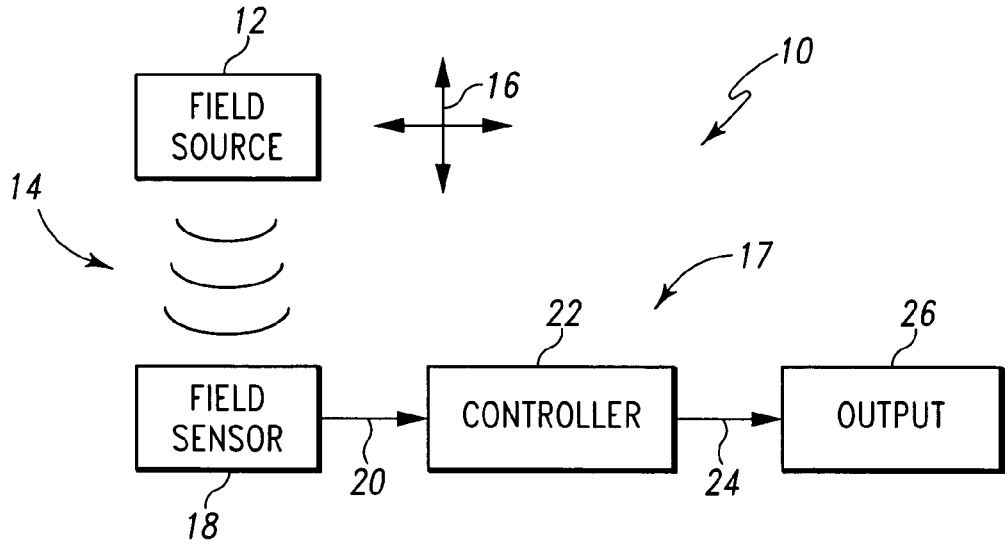
FIG. 1 is a block diagram of a toy including a field source movable relative to a field sensor.

FIG. 1 is a block diagram of an example of a toy 10 that may be used by children for such purposes. Toy 10 may include a source 12 of an electromagnetic field 14 that may be movable by a child or other user in one or more directions, as represented by multi-pointed arrow 16. Source 12 may be moved adjacent to a base circuit 17. Base circuit 17 may include a field sensor 18 that may detect the presence and/or changes in field 14. Sensor 18 may generate a sensor signal 20 in response to field 14 that is coupled to a controller 22. Controller 22 then may produce a control signal 24 based at least in part on the sensor signal. An output 26 may respond to control signal 24 by producing a sensible output.

In some examples, field source 12 may provide a constant, temporary or varying field, such as provided by a permanent magnet 28 or an electrical conductor, such as a coil. The field sensor 18 may be adapted to respond to the presence in an electromagnetic field, or to a change in an electromagnetic field. Further, the response of the sensor may be determined at least in part based upon the strength of the field and/or the rate of change of the field.

Controller 22 may be any apparatus, system or device that is responsive to a sensor signal to produce a control signal appropriate to produce an associated output. The controller may thus be as simple as a mechanical, electrical or electronic device, such as a switch. The controller may also be more complex, as appropriate, such as a signal processor, converter, filter, or logic unit. A logic unit may be a processor, such as are used in microprocessors or computers, and may be in the form of hardware, firmware, software, or analog or digital circuits.

Output 26 may be of any suitable form, such as electrical, electronic, optical, mechanical, and/or sonic in character, and may be a local or remote action and/or a signal to another device that may further process the signal from the controller, or any combination or number of such forms. Examples of outputs contained within a toy 10 may include a sensible output, such as a visible, tactile, and/or aural output. Examples of such outputs may include the illumination of one or more lights, generation of sound, movement of a movable element, generation of visible effect, such as the production of bubbles or smoke, or a combination of these. An output or combination of outputs may occur concurrently and/or in sequence, and may be continuous, intermittent, periodic or aperiodic, or a combination of these.

Figure 2:
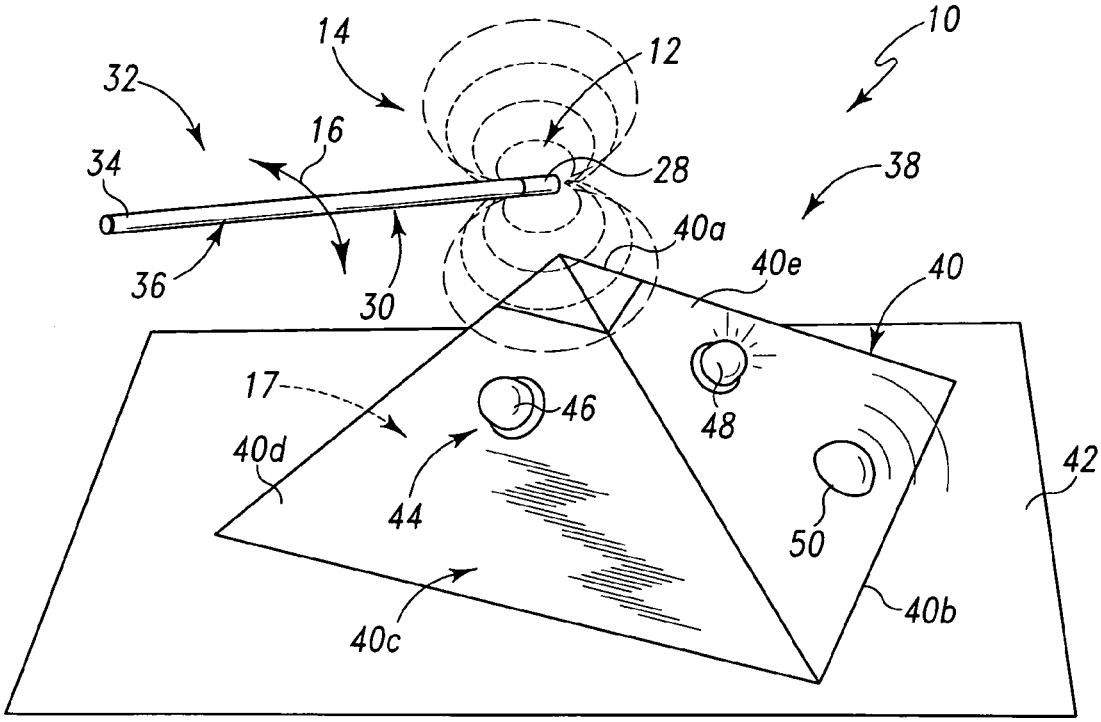
FIG. 2 is an illustration of a toy that may be made according to the toy of FIG. 1.

FIG. 2 illustrates an example of a toy 10. Field source 10 in this example may be permanent magnet 28 supported by a support 30 to form an instrument 32 allowing for manipulation of the magnet by a user. Support 30 may be of any suitable form generally allowing or providing for movement by a user, such as a mechanical apparatus, or simply a handle, such as provided by a rod 34, to form with the magnet a wand 36. Other examples of support 30 may include a ring, a string from which the magnet may be suspended, or a vehicle that carries the magnet.

The magnet 28 may be shaped to produce a magnetic field of a chosen size and/or flux density. For example, a "horseshoe" magnet may produce a more concentrated magnetic field than a bar magnet of similar strength. An electrically generated field may have a strength determined by the amplitude of current and number of turns generating the field. Further, an electrically produced field may be adapted to be controlled automatically or by a user to vary the strength and rate of change of the field, if any.

A base unit 38 may include a housing 40 adapted to house base circuit 17, including field sensor 18, controller 22 and output 26. Housing 40 may have any suitable shape, and is shown in the form of a pyramid having a pointed tip 40*a*, a broad base 40*b* with a flat bottom, not shown, and exposed surfaces 40*c*, such as faces 40*d* and 40*e*. Housing 40 may be adapted to be placed and supported in the orientation shown on a support surface 42. Support surface 42 may be any play surface selected by a user, such as a floor or table, or even a hand if the base unit is hand held. Housing 40 may be stationary on surface 42, or may be adapted to move along the surface. Optionally, the housing may have other suitable forms, such as a box, dome, character, figure, doll, or movable vehicle.

Field sensor 18 may be disposed in tip 40*a* of housing 40, where it may be conveniently approached by wand 36, as shown. Tip 40*a* may be an electromagnetically transparent cap that covers sensor 18. Similarly, controller 22 may be hidden in and supported by housing 40.

Output 26, which may be referred to as or may include an output circuit, also may be mounted in and/or on housing 40. For example output 26 may include a plurality of lights 44, such as a light 46 mounted on face 40*d* and a light 48 mounted on face 40*e*. As has been discussed, other configurations of lights may be included, and the lights may have a selected size, color and/or intensity. Output 26 may also include an audible output, such as provided by a speaker 50 mounted to housing 40. These outputs may be representative of the signal produced by sensor 18. For example a feature of the outputs may be modulated or otherwise varied according the sensor signal. For example, the number of lights, rate of flashing of the lights, the intensity of the lights, or the volume, tone and/or other characteristic of sound produced may be varied.

Figure 3:
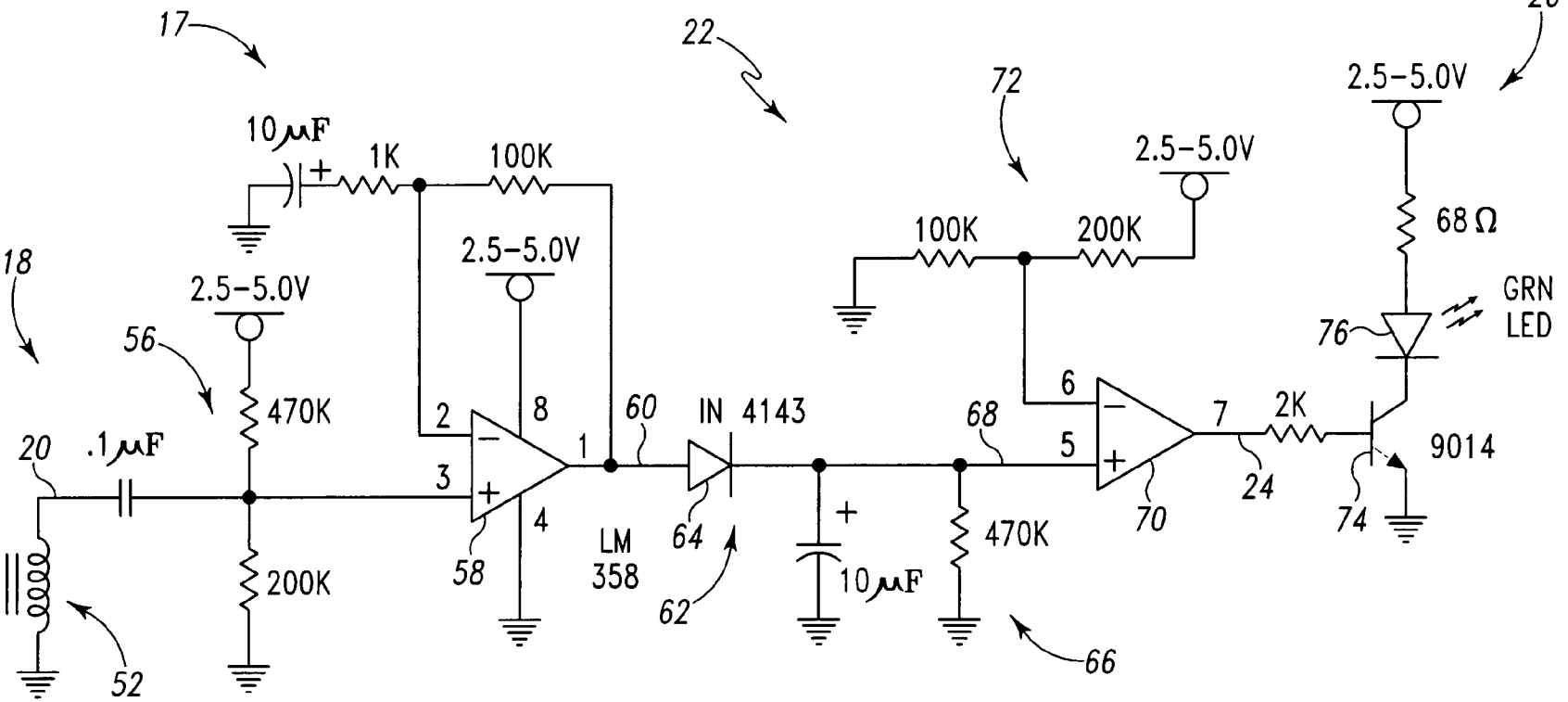
FIG. 3 is a schematic diagram of an example of a circuit suitable for use in the toy of FIG. 1.

FIG. 3 illustrates an example of a base circuit 17 that may be housed in a base unit 38. Base circuit 17 includes sensor 18, controller 22 and output circuit 26. Sensor 18 may include a reluctance coil 52. Reluctance coils may sense variation in magnetic fields, such as that produced, for example, by movement of magnet 28 relative to (toward, away from, or past) sensor 18.

Figure 4:
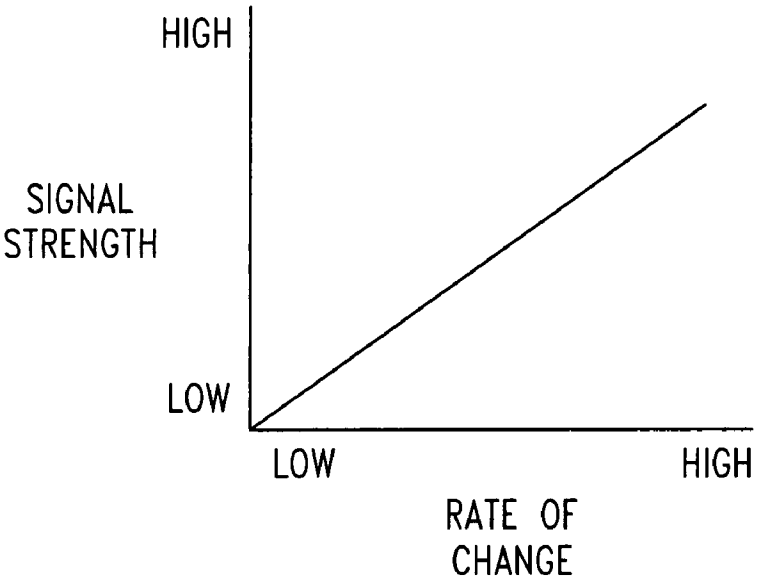
FIG. 4 is a graph illustrating an example of a response of a field sensor of FIG. 1.

FIG. 4 illustrates generally the strength of a signal produced by a reluctance coil as a function of rate of change of the field passing through the reluctance coil. For example, if the rate of change is low, relatively low signal strength may be produced. Correspondingly, a high rate of change in the field may produce relatively high signal strength. Rate of change in the field may depend on a combination of the direction of movement of the field, as well as the strength of the field. That is, small changes in a strong field may produce a signal having an amplitude similar to the amplitude of a signal produced by large changes in a weak field.

Figure 5:
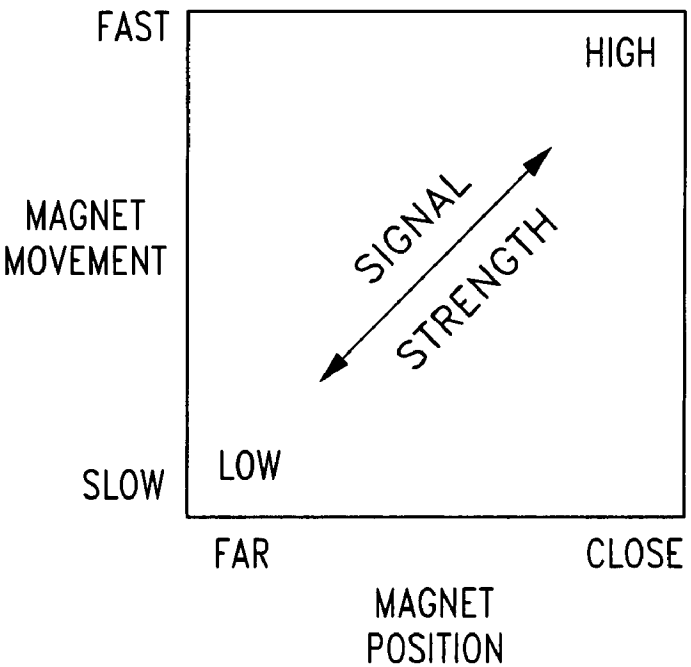
FIG. 5 is a diagram illustrating an example of the relationship between strength of signal produced by a field sensor to movement and position of a magnet as a field source relative to a field sensor.

FIG. 5 illustrates how the relationship of signal strength and rate of change in the field represented in FIG. 4, may be applied by a user in manipulating magnet 28 or other field source relative to coil 52 or other field sensor. The field of a magnet is stronger—has a higher flux density—near the poles of the magnet, and is progressively weaker with distance away from the poles. Thus, moderate signal strength may be produced by slow movement of the magnet when placed close to the coil, moderate movement of the magnet at an intermediate distance from the coil, or fast movement when further from the coil. Slow movement of the magnet when further from the coil may produce lower signal strength. Conversely, fast movement of the magnet close to the coil may produce relatively high signal strength. Further, for any given position of the magnet relative to the coil, it may be possible to move the magnet in a way that produces little change in the magnetic field strength in the coil, and conversely, it may be possible to move the magnet in a way that produces more change in the magnetic field strength in the coil. It will thus be seen that many variations in movement of a magnet or other field source by a user relative to a coil or other field sensor. It will therefore be appreciated that different rates and paths of movement of the field relative to the sensor may produce many variations in responses.

Returning to FIG. 3, coil 52 may produce a raw sensor signal 20 that is capacitively coupled through a voltage divider 56 to a non-inverting input of an operational amplifier (op amp) 58. The output of op amp 58 is an amplified signal 60. In some examples in which the output may vary as a function of the level or strength of the coil signal, op amp 58 may be considered part of controller 22, with amplified signal 60 corresponding to control signal 24. Control signal 24 may then drive further logic or control circuitry, whether analog and/or digital in form. For example, signal 60 may be applied directly to a driver for an output, such as a driver and associated light, set of lights, speaker, motor, analog-to-digital converter, digital signal processor, or other suitable device.

In this example, signal 60 may be converted to a direct current (D.C.) voltage level by a rectifier 62, here including a diode 64 and a low-pass filter 66. The resulting D.C. voltage, referred to herein as a conditioned amplified signal 68, may then be applied to the non-inverting input of a comparator 70. A selected reference voltage level may be applied to an inverting input of comparator 70, which voltage may be set by a voltage divider 72. The output of comparator 70 may then be a control signal 24 having a level determined by the voltage applied to the non-inverting input. In this example, control signal 24 may be a binary signal having a low state when the input signal is below the reference or threshold voltage, and a high state when the input signal is above the reference threshold voltage.

Control signal 24 may accordingly be input to an output circuit 26 responsive to a binary signal. The circuitry may prompt various responses, such as the on/off control of a light or sound, or the modulation of a sound so that the sound varies in relation to the velocity of the magnet relative to the reluctance coil. In this example, control signal 24 controls the operation of a transistor 74, by which the illumination of a light 76, in the form of a green light-emitting diode (LED). Light 76 is exemplary of an action device or other output having a sensible action, as has been discussed. Thus, when the input signal is higher than the threshold value set by voltage divider 72, an action device or other output 26 is activated to produce a given response.

Control signal 24 can be processed by controller 22 to have a form suitable for the particular output. In the form of controller 22 illustrated, control signal 24 may be an amplified sensor signal 60, a processed version of the sensor signal, such as conditioned signal 68, or as the bi-level signal 24. In the illustrated example, the action device is a green LED, which may light up in response to the detection of a magnetic field.

Optionally, the LED may brighten or dim as a function of the strength of the magnetic field detected, depending on the character of the control signal. In some embodiments, the green LED may be replaced with a different action device operable to produce a response based at least in part upon the detection of or change in a magnetic field. As has been discussed with reference to FIGS. 1 and 2, such action devices may be a speaker, which may be caused to emit a sound, or a moving part, which may be caused to move, or a combination of similar or different action devices. When one or more lights are included in the output, the display modes may include a suitable form of variation in light, such as different colors, different combinations of lights, different numbers of lights, different intensities of lights, different numbers of times one light is or plural lights are illuminated, or different rates of varying light illumination. When a speaker is included in the output, sound variation may be in the volume of a sound produced, a duration of a sound produced, and/or a character of a sound produced. The sound may have any suitable characteristic, such as tones, notes, music, words, sound effects and/or combinations of them.

Figure 6:
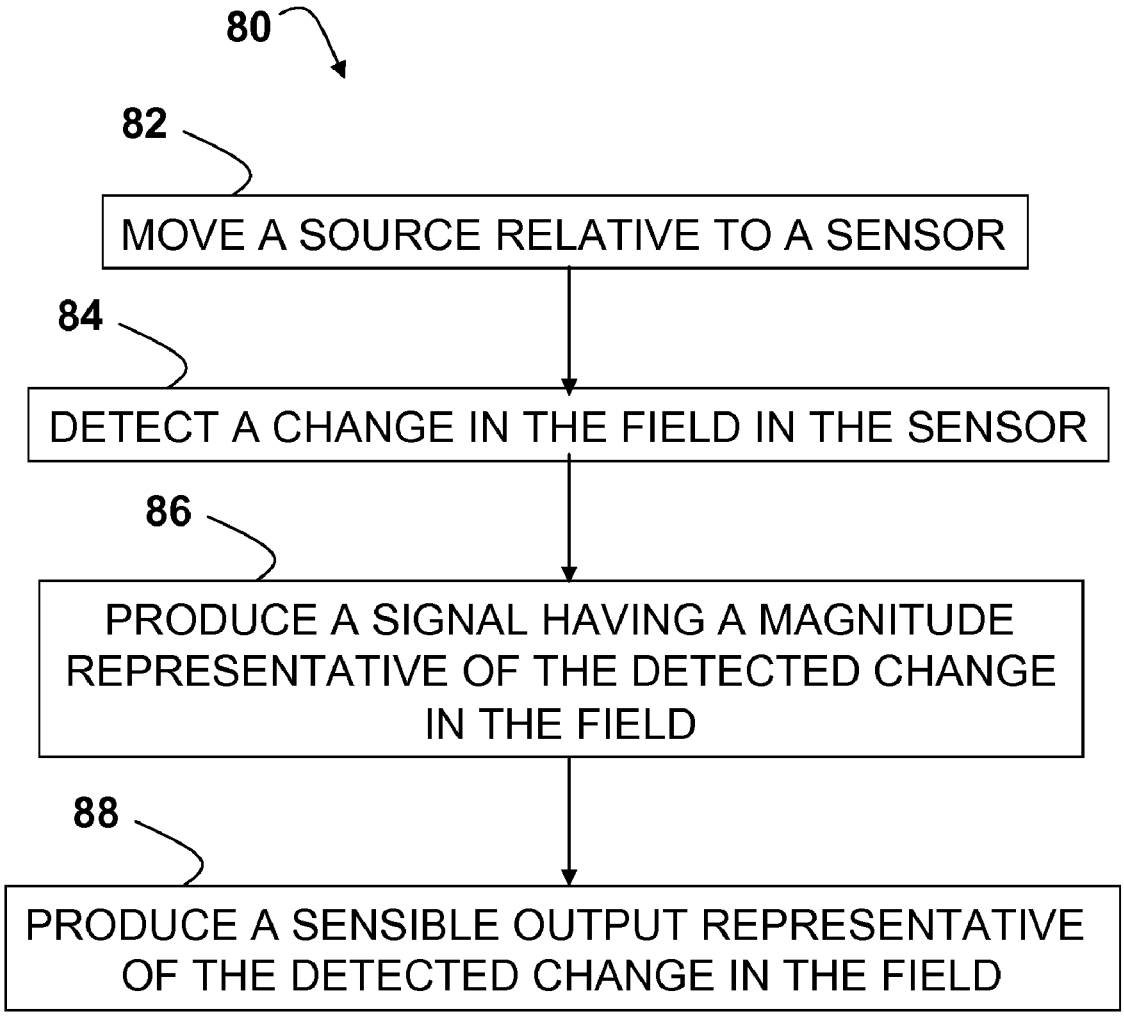
FIG. 6 is a flowchart illustrating a method of operating a toy made according to FIG. 1.

As illustrated in FIG. 6, it can be seen that the described toy 10 in use provides a method 80 of operating a field-responsive toy that may include in a step 82 moving the field source relative to the sensor, in a step 84 detecting a change in the field in the sensor, in a step 86 producing a signal having a magnitude representative of the detected change in the field, and in response to the produced signal, in a step 88 producing a sensible output representative of the detected change in the field. In some examples, step 84 may include detecting a different change in the field in the sensor, step 86 may include producing a signal having a magnitude representative of the detected different change in the field, and step 88 may include producing a different sensible output representative of the detected different change in the field.

It will be appreciated that a toy 10 may comprise a magnet adapted to be moved by a user relative to a base unit supported on a support surface. The base unit may include a housing adapted to be supported in a fixed position relative to the surface and a magnetic-field sensor supported in the housing. The field sensor may be adapted to produce a sensor signal having a magnitude representative of a change in a magnetic field of the magnet passing through the sensor. An amplifier may be adapted to amplify the sensor signal. Further, a comparator may be adapted to produce a control signal corresponding to the amplified sensor signal when the amplified sensor signal exceeds a threshold value. An output circuit may include at least one light and/or speaker that is activated corresponding to the control signal.

Thus, with the toy 10 illustrated in FIG. 2, a child waving a wand 36 equipped with a small magnet 28 may create the illusion of performing magical actions based on the responses produced by the base unit 38. Some embodiments may include one or more wands or other user-movable portions, each of which may include one or more magnets. Some embodiments may include one or more base units, each of which may be configured to produce a specific response, a combination of responses, or a random or predetermined sequence of responses when motion of a magnet is detected. Further, base units may remain stationary on a support surface 42, or move along the support surface, such as in response to movement of the magnet.

It is believed that the disclosure set forth above encompasses multiple distinct embodiments and methods with independent utility. While each of these embodiments and methods may have been disclosed in a preferred form, the specific embodiments and methods as disclosed and illustrated herein are not to be considered in a limiting sense as numerous variations are possible. The subject matter of the embodiments and methods includes all novel and non-obvious combinations and subcombinations of the various elements, features, steps, functions and/or properties disclosed herein.

Inventions embodied in various combinations and subcombinations of features, functions, elements, and/or properties also may be claimed through presentation of claims in a related application or after the submission of the original claims. Such claims, whether they are directed to embodiments or methods different from those claimed herein or directed to the same embodiments, whether different, broader, narrower or equal in scope to the original claims, are also regarded as included within the subject matter of the present disclosure.

Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

INDUSTRIAL APPLICABILITY

The methods and apparatus described in the present disclosure are applicable to toys, such as dolls, action figures, games, and other devices, and other industries in which amusement devices are used.

We claim:

1. A toy comprising:

a housing;

an electromagnetic field sensor supported in the housing, and adapted to produce a signal having a magnitude representative of a change in an electromagnetic field passing through the sensor;

a changeable output, the output being changeable in magnitude;

a controller adapted to change the output for different magnitudes of the signal, the controller being further adapted to change the magnitude of the output for a change in the magnitude of the signal; and a source of a magnetic field, the source being moveable by a user relative to the sensor to expose the sensor to an electromagnetic field that changes according to movement of the source relative to the sensor by the user.

2. The toy of claim 1, in which the output includes one or more of a light and/or a speaker.

3. The toy of claim 2, in which the controller is adapted to operate the output to vary one or more of illumination and/or sound when the magnitude of the signal varies.

4. The toy of claim 1, in which the controller includes a comparator adapted to detect when the signal reaches a threshold level, and the controller operates the output when the signal exceeds the threshold level.

5. The toy of claim 1, in which the housing includes a base adapted to support the field sensor in a fixed position relative to a support surface.

6. A toy comprising:

a magnet adapted to be moved by a user relative to an external surface; and a base unit, the base unit including a housing adapted to be supported in a fixed position relative to the surface;

a magnetic-field sensor supported in the housing, and adapted to produce a sensor signal having a magnitude representative of a change in a magnetic field of the magnet passing through the sensor;

an amplifier adapted to amplify the sensor signal;

a comparator adapted to produce a control signal representative of the magnitude of the amplified sensor signal when the amplified sensor signal exceeds a threshold value; and an output circuit including at least one light and/or speaker, the output circuit activating the at least one light and/or speaker corresponding to the control signal.

7. The toy of claim 6, in which the output circuit modulates the light illumination according to the magnitude of the sensor signal.

8. The toy of claim 6, wherein the comparator is further adapted to produce a control signal representative of a magnitude of the amplified sensor signal, and the output circuit is further adapted to change a magnitude of an output produced by at least one light and/or speaker for a change in the magnitude of the sensor signal.

9. A method of operating a toy including an electromagnetic field sensor, a sensible output, and a source of an electromagnetic field, the method including:

moving the field source relative to the sensor;

detecting a magnitude of change in the field in the sensor;

producing a signal having a magnitude representative of the detected magnitude of change in the field; and in response to the produced signal, producing a sensible output representative of the detected magnitude of change in the field.

10. The method of claim 9, further comprising detecting a different magnitude of change in the field in the sensor, producing a signal having a magnitude representative of the detected different magnitude of change in the field, and producing a different sensible output representative of the detected different magnitude of change in the field.

11. The method of claim 10, wherein producing a different sensible output includes changing the magnitude of the sensible output for a change in the magnitude of the signal.

* * * * *